United States Patent [19]

Kato et al.

[11] 3,977,618

[45] Aug. 31, 1976

[54] APPARATUS FOR AUTOMATICALLY CONNECTING THE SHEET MATERIAL OF ONE ROLL TO SHEET MATERIAL OF ANOTHER ROLL

[75] Inventors: Mikio Kato, Isehara; Yasuhiro Kojima, Odawara, both of Japan

[73] Assignee: Nihon Electronic Industry Co., Ltd., Japan

[22] Filed: Mar. 1, 1974

[21] Appl. No.: 447,334

[30] Foreign Application Priority Data

Oct. 29, 1973. Japan ..... 48-120685

[52] U.S. Cl. ..... 242/58.3

[51] Int. Cl.² ..... B65H 19/10

[58] Field of Search ..... 242/58.1, 58.2, 58.3, 242/58.4, 58.5

[56] References Cited

UNITED STATES PATENTS

| | | | |
|---|---|---|---|
| 2,070,317 | 2/1937 | Roesen | 242/58.5 |
| 2,089,635 | 8/1937 | Wood | 242/58.3 |
| 2,386,344 | 10/1945 | Roesen | 242/58.2 |
| 3,309,036 | 3/1967 | Anderson | 242/58.3 |
| 3,326,485 | 6/1967 | Huck | 242/58.3 |
| 3,460,775 | 8/1969 | Ford et al. | 242/58.3 |

FOREIGN PATENTS OR APPLICATIONS

| | | | |
|---|---|---|---|
| 231,709 | 12/1960 | Australia | 242/58.1 |

*Primary Examiner*—Stanley N. Gilreath
*Assistant Examiner*—John M. Jillions
*Attorney, Agent, or Firm*—Steinberg & Blake

[57] ABSTRACT

An apparatus for uninterruptedly feeding sheet material sequentially from a plurality of rolls. A first roll from which the sheet material is continuously unwound is displaced away from a feed position by swinging a frame, carrying the first roll and a second roll to replace the first roll, around a predetermined axis while the second roll is moved to the feed position. With the second roll at the feed position, the web which continues to travel from the first roll is pressed against the second roll which is then rotated while maintained in engagement with the web, this operation being brought about by a combined pressing and driving structure which presses the web of the first roll against the second roll and which rotates the second roll simultaneously with the travel of the sheet material from the first roll. Then the web which continues to issue from the first roll is attached to the outermost layer of the second roll so that unwinding of the latter starts, and a cutter is then operated to cut across the web issuing from the first roll so as to terminate the feeding from the latter while continuing the feed without interruption from the second roll.

4 Claims, 12 Drawing Figures

APPARATUS FOR AUTOMATICALLY CONNECTING THE SHEET MATERIAL OF ONE ROLL TO SHEET MATERIAL OF ANOTHER ROLL

BACKGROUND OF THE INVENTION

The present invention relates to the feeding of sheet material such as paper.

Thus, the present invention is particularly appplicable to the feeding of paper in a machine which supplies corrugated paper. With machines of this general type the sheet material is derived from rolls of the sheet material, with the sheet material being unwound from the rolls during the feeding of the sheet material. Thus, when one roll has been almost completely unwound it is necessary to connect the sheet material thereof to the leading end of the sheet material from a second roll, in order to provide in this way a continuous feeding of the sheet material.

However, the above operations are accompanied by problems which up to the present time have not been satisfactorily solved. These problems arise from the fact that a sheet material such as paper is not rolled in a standardized manner. Thus such sheet material has a front surface and a rear surface and some manufacturers supply the sheet material in rolls where the front surface is directed inwardly toward the axis of the roll whereas other manufacturers supply such rolls with the front surface directed outwardly away from the axis of the roll. As a result, it often happens that the front surfaces of the sheet material are reversed when connecting a web from one roll to the web from the preceding roll. The result is that the exterior surface of the final product has an irregular appearance which is highly undesirable.

It is known to carry out operations of the above type manually. The manual joining of the leading end of sheet material from one roll to the trailing end of sheet material from an exhausted roll requires operations such as cutting the sheet material issuing from the roll which is about to be exhausted and then making a connection to the leading end of the sheet material from the new roll. These operations when manually carried out require a considerable amount of skill in order to achieve the effective connections while avoiding waste of large amounts of sheet material. Moreover it is necessary in connection with such manual operations either to terminate the feed or to temporarily reduce the feed velocity of the sheet material so as to enable the change of the supply from one roll to the next to be carried out while avoiding undesirably large amounts of residual sheet material on a replaced roll. This termination or reduction in the speed with which the sheet material is fed may result in a loss of quality in the final product. This latter fault is likely to be encountered particularly with products which are dried, as is the case with corrugated paper, inasmuch as the slowing down of the operations easily results in over-drying of the product.

Elimination of problems of the above type is particularly important in view of the fact that in recent times the production speed in the manufacture of material such as corrugated paper has been greatly increased, and thus it is essential to avoid the above problems in order to be able to achieve a uniform standardized product of high quality.

SUMMARY OF THE INVENTION

It is accordingly a primary object of the present invention to provide an apparatus which will avoid the above problems.

In particular, it is an object of the present invention to provide an apparatus which will enable the feeding of sheet material to go forward without interruption sequentially from a plurality of supply rolls, without necessitating any reduction in the speed with which the sheet material is fed sequentially from the plurality of supply rolls.

In particular it is an object of the present invention to provide an apparatus which make it possible to bring the speed of rotation of a new supply roll up to a level adequate to provide for issue of sheet material from the new roll at a speed which is the same as that with which the sheet material issues from a roll which is almost exhausted, with the attachment of the sheet material from the new roll to the sheet material from the immediately preceding roll being brought about in such a way that a continuous feed of the sheet material is achieved when changing from one roll to the next.

It is furthermore an object of the present invention to provide an apparatus of the above type which make it possible in an extremely convenient manner to maintain the front and rear surfaces of webs of sheet material from successive rolls oriented in the same directions irrespective of whether a new supply roll has the sheet material wound thereon with the front surface directed inwardly or outwardly.

It is furthermore an object of the present invention to provide an apparatus for carrying out operations of the above type with a minimum waste of sheet material.

Also it is an object of the present invention to provide an apparatus for carrying out operations of the above type in an effective reliable manner while the apparatus at the same time is relatively simple and rugged and easy to operate.

In accordance with the invention when the supply of sheet material from a first roll at a given location is about to be terminated the first roll is displaced away from the latter location while a second roll is simultaneously moved to the latter location, without any interruption in the issue of sheet material from the first roll. Then the web from the first roll is pressed against the second roll while the latter is simultaneously rotated without any slip between the second roll and the web from the first roll. With the second roll thus rotating the web which continues to issue from the first roll is attached to the outermost layer of the second roll so that the sheet material starts to unwind from the latter, and finally the web issuing from the first roll is cut at a location between the first roll and the attachment of the web from the first roll to the web from the second roll, so that now the feed continues with the sheet material from the second roll and the feed from the first roll is terminated.

The above operations are brought about by way of a frame means supported for swinging movement about an axis situated between the axes of the first and second rolls which are carried by the frame means, the first roll being in a feeding position while the sheet material is unwound therefrom and the second roll being located in readiness to occupy the feeding position. Thus when the frame means is swung the first roll is displaced away from the feed position while the second roll is moved to the feed position. A combined pressing and rotating means then presses the web from the first roll against the second roll and rotates the latter without any slip between the rotating second roll and the web issuing from the first roll. An attaching means is operatively connected with the combined pressing and rotating means to attach the outermost layer of the second roll to the web issuing from the first roll so that now sheet material starts to be unwound from the second roll. A cutting means is operatively connected to the combined pressing and rotating means to cut across the web issuing from the first roll after attachment of the latter web to the outermost layer from the second roll, so that in this way the feeding will continue from the second roll and terminate from the first roll.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
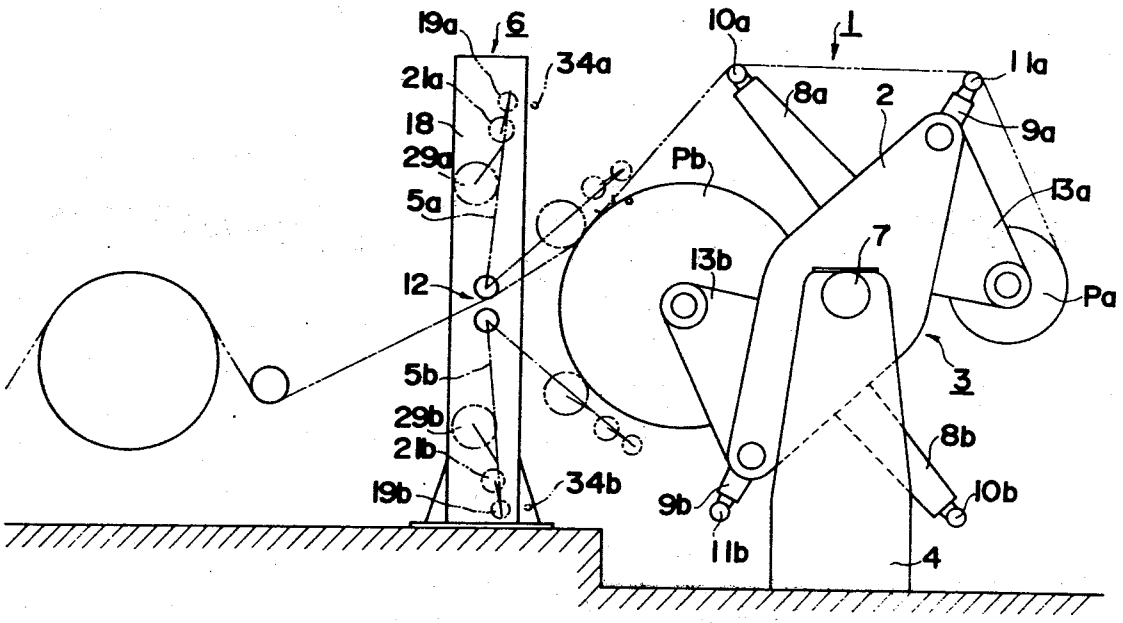
FIG. 1 is a schematic side elevation of an apparatus according to the invention for carrying out the method of the invention.

Referring to FIG. 1, there is shown at the right part thereof a sheet-material supply unit 1 in the form of a suitable stand which includes a swingable frame means 3 which supports for free rotary movement in the position of the parts shown in FIG. 1 an almost exhausted roll Pa of sheet material such as paper and a fresh new roll Pb from which the web is to be withdrawn in order to continue the feed of sheet material without interruption when changing from the roll P*a* to the roll P*b*. The frame means 3 includes a pair of side plates 2 supported for swinging movement on a horizontal shaft 7 which forms part of a support means which includes a suitable stand or base 4 which carries the shaft 7 on which the side plates 2 are supported for free swinging movement. Thus, the plates 2 can swing around the horizontal axis of the shaft 7 and are suitably spaced from each other by transversely extending rods or the like so that the space between the plates 2 is large enough to accommodate the sheet-material rolls P*a* and P*b*.

A connecting unit 6 for connecting the trailing end of the sheet material from the almost exhausted roll to the leading end of the sheet material from the new roll is shown in FIG. 1 to the left of the unit 1. The unit 6 includes a stationary frame 18 which also forms part of the support means for the structure of the invention, this frame 18 having a pair of opposed upright beams and a horizontal beam extending across and connected between the horizontal beam extending across and connected between the tops of the upright beams, as is apparent from FIG. 2. The frame 18 of the support means is shown schematically in FIG. 1. As is indicated in FIG. 1, the part 18 of the support means swingably supports an upper combined pressing and rotating means which includes a pair of swingable arms or levers 5*a* and a pair of pressing and driving rolls 29*a* as well as a lower combined pressing or rotating means which includes a pair of lower arms or levers 5*b* and a pair of lower pressing and driving rolls 29*b*. The upper combined pressing and rotating means is swingable from the almost upright position shown in FIG. 1 in a clockwise direction to the illustrated operating position where the rolls 29*a* press the web which still issues from the almost exhausted roll P*a* against the new supply roll P*b*, and in the same way the lower combined pressing and rotating means is swingable from the rest position where it extends almost vertically in a counterclockwise direction to the illustrated operating position where the rolls 29*b* are shown in engagement with the supply roll P*b*.

The pair of side plates 2 of the swingable frame means 3 each fixedly carry extension 8*a*, 9*a*, 8*b*, and 9*b*, arranged as illustrated, and these extensions project into the space between the first roll P*a* and second roll P*b*. The pair of extensions 8*a*, one of which is visible in FIG. 1, support at their outer ends for free rotary movement an idler roll 10*a*, and in the same way the several pairs of extensions 9*a*, 8*b*, 9*b*, respectively support for free rotary movement idler rolls 11*a*, 10*b*, 11*b*. The pair of uprights of the frame 18 of the support means support for free rotary movement in a manner described in greater detail below a pair of idler rolls 35*a* and 35*b*, shown in FIG. 2, and these rolls define between themselves an elongated horizontally extending slot 12 through which the sheet material such as paper is fed in order to be further treated in a known way. Thus part of the web issuing from the almost exhausted roll P*a* of FIG. 1 is shown extending through this slot 12 defined between the idler rolls 35*a* and 35*b*. The length of the extensions 8*a*, 9*a*, 8*b*, 9*b* is such that the idler rolls of the frame means 3 which are nearest to the slot 12, the idler rolls 10*a* and 11*b* in FIG. 1, are situated above and below the second roll P*b* from which the sheet material is about to be withdrawn by a distance sufficient to enable a straight line drawn in the plane of FIG. 1 from the slot 12 to the roll 10*a* and a straight line drawn from the slot 12 to the roll 11*b* to clear or be situated outwardly beyond the roll P*b*. This same relationship obtains when the idler rolls 11*a* and 10*b* are nearest to the slot 12. As a result of this arrangement it is possible to locate the second roll P*b* in the feed position as shown in FIG. 1, formerly occupied by the first roll P*a*, without any engagement between the web which continues to issue from the roll P*a* and the second roll P*b* while the latter moves to the feed position at which it is illustrated in FIG. 1.

In the particular example which is illustrated in FIG. 1 each of the side plates 2 is shown as being provided with extensions or brackets 13*a* and 13*b* respectively fixed thereto for carrying the rolls of sheet material, these brakcets 13*a* and 13*b* being symmetrically arranged on opposite sides of the axis of the shaft 7. It is also possible to provide a different arrangement where the rolls of sheet material can be situated adjacent the ends of the side plates 2. With such an altered arrangement the extension 8*a*, 9*a*, 8*b*, 9*b*, will be arranged differently so as to provide the above relationship according to which the web of sheet material issuing from the almost exhausted roll will not engage the new roll during the time when the frame means 3 is swung in order to displace the almost exhausted roll away from the feed position while moving the new roll simultaneously into the feed position.

The swingable frame means 3 of the unit 1 is in a cooperative relationship with a means which senses the position of the frame means 3 so as to stop the swinging or rotary movement thereof when the second roll of sheet material P*b* has reached the feed position formerly occupied by the first roll P*a*, this being the position shown in FIG. 1. In order to provide such an arrangement a detection means may be provided to detect when the frame mens 3 has been turned through an angle sufficient to situate the new roll at the feed position and to then bring about a termination of the swinging of the frame means 3. Such a detection means may include known optical or mechanical devices.

Figure 7:
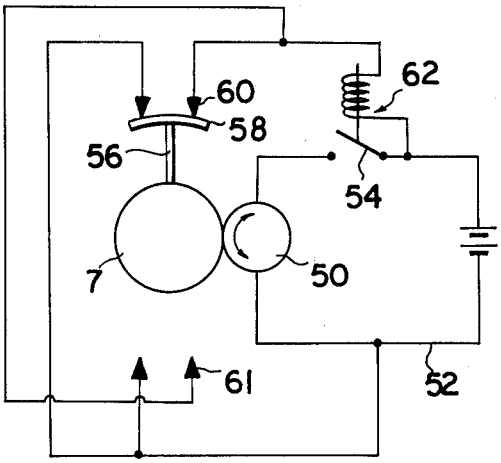
FIG. 7 is a schematic representation of a structure for automatically limiting the turning of the roll-carrying frame.

In the particular example which is shown in FIG. 7 in a schematic manner, the shaft 7 is schematically illustrated, this shaft being fixed to the side plates 2 and being connected by any suitable gearing or other transmission to a reversible motor 50 which is only schematically illustrated. This reversible motor 50 is shown as connected into an electrical circuit 52 so as to turn in a selected direction upon manual closing of a switch 54. The manner in which the switch 54 is constructed and connected to the motor 50 to provide a selected direction of rotation thereof is well known. A part of the shaft 7 which is situated beyond the stand 4 carries an extension 56 of electrically non-conductive material, and this extension carries a conductive strip 58 which in the position shown in FIG. 7 bridges across a pair of contacts 60 so as to close a circuit through a solenoid 62 operatively connected with the switch 54 to open the latter when the solenoid 62 is energized. The operator will manually hold the switch 54 closed when it is desired to rotate the frame means 3 in one or the other direction of rotation, and the simple closing of this switch 54 manually for a second or so will be sufficient to move the bridging element 58 beyond the position extending between the contacts 60 so that the solenoid 62 becomes unenergized and the switch 54 will remain closed. As the shaft 7 together with the remainder of the frame means 3 is driven in one or the other direction the bridging element 58 will reach a pair of contacts 61, and upon bridging across the latter will also energize the solenoid 62 so as to open the switch 54, thus automatically stopping the swinging movement of the frame means 3. In the illustrated example the frame means 3 is swung at each operation in one direction or the other through approximately 180° so that the arrangement as shown in FIG. 7 will be adequate to bring about an automatic stopping of the frame means 3 when the second roll has reached the feed position.

Figure 2:
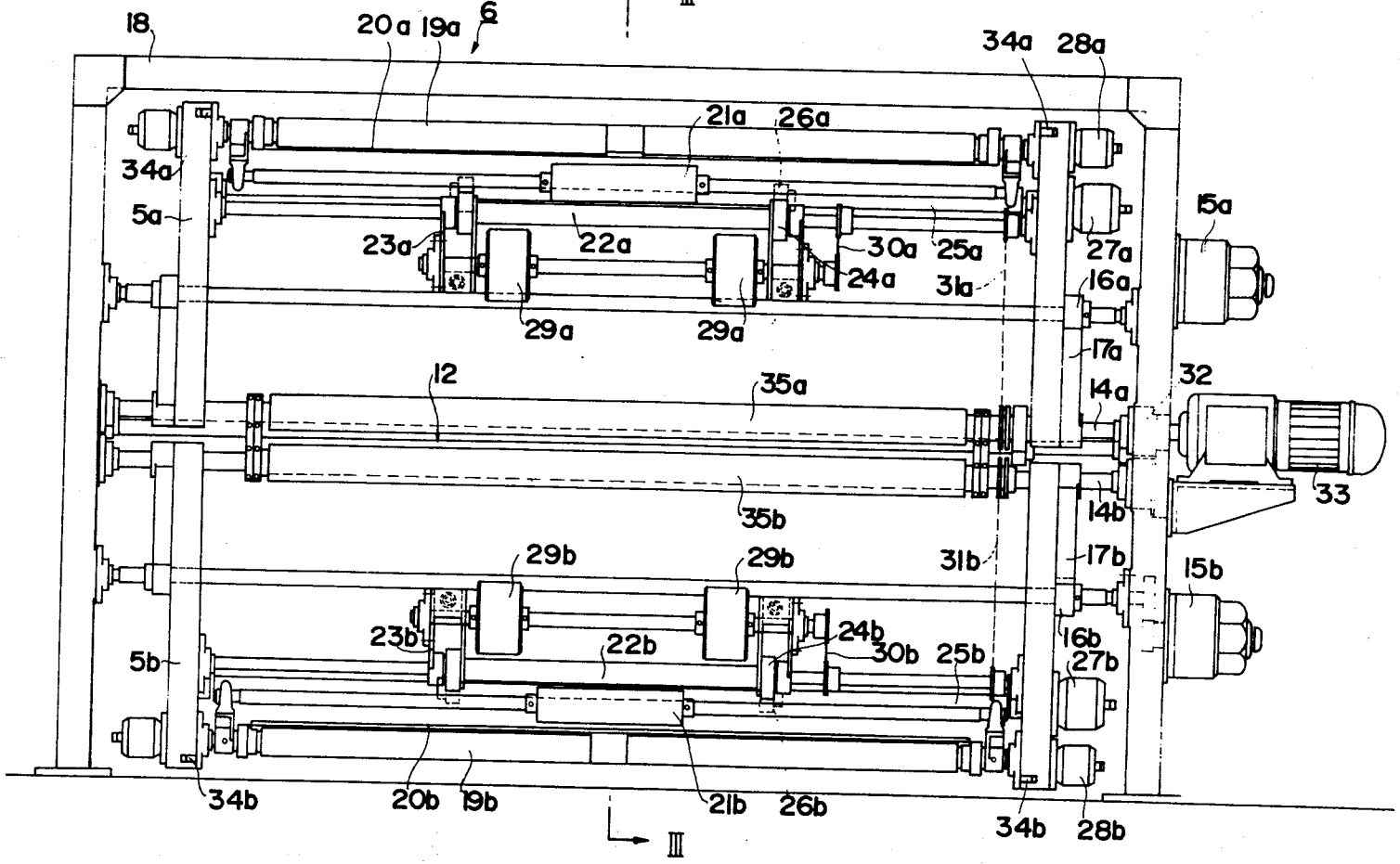
FIG. 2 is an elevation, taken in a plane which is transverse with respect to FIG. 1, showing a stand provided with structure for connecting a web from one roll to the web of another roll.
Figure 3:
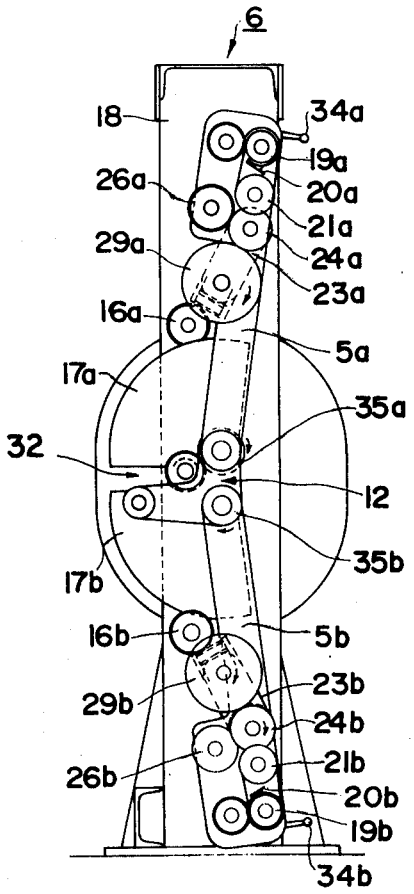
FIG. 3 is a longitudinal sectional elevation showing the structure of FIG. 2 in a schematic manner and taken along line III—III of FIG. 2 in the direction of the arrows.

Referring now to FIGS. 2 and 3, the uprights of the frame 18 of the support means support for free rotary movement a pair of elongated shafts 14*a* and 14*b* which extend horizontally between these uprights and which are supported for rotary movement by any suitable bearings, and the idler rollers 35*a* and 35*b* which define between themselves the slot or gap 12 referred to above are in the form of sleeves or tubes through which the shafts 14*a* and 14*b* extend with these idler rollers supported for free rotary movement on the shafts in any suitable way. As the sheet material such as paper travels through the gap or slot 12 a smoothing of the supply of the sheet material takes place. The upper shaft 14*a* serves to swingably support the pair of arms or levers 5*a* of the upper combined pressing and rotating means while the lower shaft 14*b* serves to swingably support the arms or levers 5*b* of the lower combined pressing and rotating means. Thus, the idler 35*a* is situated between the ends of the arms 5*a* which are swingable on the shaft 14*a* while the idler 35*b* is situated between the ends of the arms 5*b* which are swingable on the shaft 14*b*, and the arms 5*b* are respectively situated in the same planes as the arms 5*a*. Sector-shaped gears 17*a* are also swingable on the shaft 14*a* and are respectively fixed to the arms 5*a* at the surfaces of the latter which are directed outwardly away from each other, as is apparent from FIG. 2, and in the same way a pair of sector gears 17*b* are swingable on the shaft 14*b* and are fixed to the outer surfaces of the arms 5*b*. A pair of pinions 16*a*, carried by a suitable shaft which extends between and is supported for rotation by the uprights of the frame 18, respectively mesh with the sectors 17*a* and are driven by a suitable transmission from a motor 15*a*. A pair of pinions 16*b* also carried by a suitable shaft which extends horizontally between the uprights of the frame 18 and which is supported for rotary movement by any suitable bearings mesh with the sectors 17*b*, and the pinions 16*b* are driven through a suitable transmission from the motor 15*b*. These motors are supported on the right upright of FIG. 2 and are driven from any suitable source in a manner described below. As may be seen from FIG. 3, the upper arms 5*a* will swing from the illustrated rest position downwardly in a clockwise direction to their operating position and then back to the rest position shown in FIG. 3 while the lower arms 5*b* will swing upwardly from the illustrated rest position in a counterclockwise direction to the operating position and then back to the rest position.

The upper free ends of the arms 5*a* support for rotary movement an elongated horizontally extending shaft which extends through a sleeve or tubular roller 19*a* which forms an induction or guide roller. In the same way the lower free ends of the arms 5*b* support for free rotary movement a horizontal shaft which extends between these arms and through a tubular lower guide or induction roller 19*b*. These rollers 19*a* and 19*b* are freely rotatable on the latter shafts, respectively. Situated in proximity to but spaced slightly from the guide roller 19*a* is an elongated cutter 20*a* forming a cutting means for a purpose referred to below. This cutter 20*a* is in the form of an elongated horizontally extending cutting blade connected at its ends to a pair of sleeves or rings which are fixed to the shaft which extends through the guide roller 19*a*, so that when this shaft is rotated the cutting means 20*a* will turn around the axis of the roller 19*a*. In the same way the lower combined pressing and rotating means has operatively connected therewith a cutting means 20*b* in the form of an elongated blade fixed at its ends to the rings or sleeves which are fixed to the shaft which extends through the lower guide roller 19*b*. These cutters 20*a* and 20*b* are coextensive with the guide roller 19*a* and 19*b*. The arms 5*a* and 5*b* carry at their outer ends driving motors 28*a* and 28*b*, respectively, these motors being driven in any suitable way and being operatively connected with the shaft which extends through the rollers 19*a* and 19*b* so as to turn the cutters in order to cut the sheet material in a manner referred to below.

Situated in alignment with a central portion of the guide roller 19*a* is a pressure roller 21*a* which forms an attaching means for attaching the web of the new roll to the web of the almost exhausted roll in a manner described in greater detail below. This attaching roller 21*a* is carried by an elongated horizontally extending shaft the ends of which are supported by the free ends of a pair of arms which are connected with the shaft which extends through the guide roller 19*a*. Thus these arms are respectively situated outwardly beyond the rings or sleeves which connect the blade 19*a* to the shaft extending through the guide roller 19*a*. These arms which thus support the shaft which carries the attaching roller 21*a* are connected with the shaft extending through the roller 19*a* in such a way that these arms will swing with this shaft when the motor 28*a* is energized. Thus upon energizing of the motor 28*a* the attaching means 21*a* will be operated and the cutting means 20*a* will also be operated. The arms which carry the shaft on which the attaching means 21*a* is mounted may be fixed to the shaft which carries the cutter 20*a* or these arms may have a frictional engagement with this shaft forming a friction-clutch type of engagement according to which when the motor 28*a* is energized the roller 21*a* will press a web from the almost exhausted roll against the new roll while continued rotation of the shaft driven by the motor 28*a* will turn the cutter 20*a* through an angle sufficient to cut across the sheet material issuing from the almost exhausted roll, as will be apparent from the description which follows.

In the same way a pressing roller or attaching means 21*b* is aligned with a central portion of the lower guide roller 19*b* and carried by a shaft which extends between and is carried by the free ends of a pair of arms connected with the shaft extending through the roller 19*b* and driven by the lower motors 28*b*.

A further shaft which extends between and is carried by the arms 5*a* at a location somewhat closer to the slot 12 than the attaching means 21*a* serves to swingably support a pair of swingable arms assemblies 23*a*. Thus FIG. 2 shows this shaft 22*a* which carries the swingable arms 23*a*, and in the same way the lower combined pressing and rotating means includes the shaft 22*b* which supports the pair of arm assemblies 23*b* for swinging movement. The arm assemblies 23*a* are fixed with gears 24*a* which are turnable about the shaft 22*a* and which respectively mesh with gears 26*a* fixedly mount on a shaft 25*a* which is supported for rotation between the arms 5*a* and which is driven by a motor 27*a*. In the same way a lower motor 27*b* drives the shaft 25*b* which fixedly carries the gear 26*b* which respectively mesh with the gears 24*b* which are fixed to the lower arm assemblies 23*b*.

The pair of arm assemblies 23*a* support for rotary movement a horizontally extending shaft which fixedly carries a pair of drive rolls 29*a*, and in the same way the lower arm assemblies 23*b* support for rotary movement a horizontally extending shaft which fixedly carries a pair of lower drive rolls 29*b*. It will be noted that the attaching means 21*a* is aligned with the space between the drive rolls 29*a* and in the same way the attaching means 21*b* is aligned with the space between the drive rolls 29*b*. Moreover the space between the rolls 29*a* is of greater length than the length of the attaching roller 21*a*, and the space between the rolls 29*b* is of greater length than the attaching roller 21*b*.

The right end of the shaft which carries the drive rolls 29*a*, as viewed in FIG. 2, is fixed with a pulley or sprocket wheel connected by way of an endless belt or chain 30*a* to a pulley or sprocket wheel which is fixed to the shaft 22*a* on which the gears 24*a* and the arm assemblies 23*a* are freely turnable. This pulley or sprocket wheel which is fixed to the shaft 22*a* is driven when the shaft 22*a* is driven, and for this purpose the shaft 22*a* carries adjacent its right end, as viewed in FIG. 2, a further pulley or sprocket wheel connected to an endless belt or chain 31*a* which extends around a pulley or sprocket wheel fixed to the shaft 14*a* which is driven through a suitable transmission 32 from the motor 33. Through this transmission 32 the motor 33 also serves to drive the shaft 14*b* which fixedly carries a pulley or sprocket wheel engaging the belt or chain 31*b* which drives a pulley or sprocket wheel fixed to the shaft 22*b* so as to rotate this shaft which carries an additional pulley or sprocket wheel engaging the belt or chain 30*b* which engages the pulley or sprocket wheel fixed to the right end of the shaft which carries the drive rolls 29*b*. The motor 33 is a reversible motor and through the above transmission when the drive rolls 29*a* are rotated in a clockwise direction, as viewed in FIG. 3, the rolls 29*b* are also rotated in a clockwise direction, whereas when the rolls 29*b* are rotated in a counterclockwise direction, the rolls 29*a* will also rotate in a counterclockwise direction, for a purpose referred to below.

The arm assemblies 23*a* and 23*b* carry known sensors for sensing the speed of rotation of the driving rolls 29*a* and 29*b*, these sensors being electrically connected with the motor 33 so as to control the latter to drive the rolls 29*a* and 29*b* at a speed which is the same as the speed with which these rolls are driven by an external force. In the apparatus of the invention the external force will be the speed of rotation applied to the rolls 29*a* or 29*b* by the travelling web of sheet material issuing from the almost exhausted roll P*a*.

The arms 5*a* carry at their outer ends optical sensors 34*a* while the arms 5*b* carry at their outer ends optical sensors 34*b*, and these sensors are positioned at the outer end regions of the arms 5*a* and 5*b* so as to be located outwardly beyond all of the rollers and cutters and outwardly beyond the sides of the roll P*b* situated at the feed position. These optical sensors will sense the outer layer of the roll P*b* so as to stop the turning of the arms 5*a* by the motor 15*a*, thus determining the operating position of the upper combined pressing and rotating means. In the same way the lower sensors 34*b* will determine the operating position of the lower combined pressing and rotating means. Thus the movement of each of the combined pressing and rotating means to its operating position can go forward without interrupting the continuous travel of sheet material from the almost exhausted roll P*a*, and at the same time the operating positions will be determined in accordance with the particular diameter of the new roll P*b*, so that rolls P*b* of different diameters can be properly handled according to the method and apparatus of the invention.

The manner in which the structure of the invention described above operates in accordance with the method of the invention is set forth below.

Figure 4A:
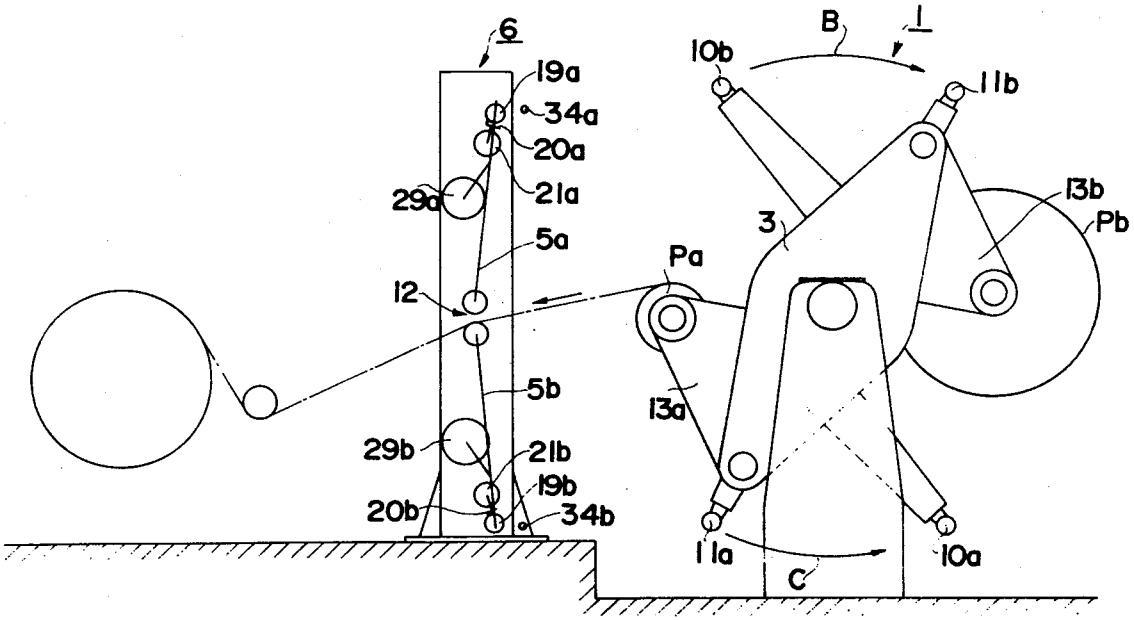
FIG. 4A diagrammatically represents the structure in a position for changing a new roll for a roll which is almost exhausted.

FIG. 4A shows the position which the components take when a roll P*a* has become almost exhausted and is to be replaced by a second roll P*b*, the roll P*a* being shown at the feed position in FIG. 4A. Thus, in this position the roll P*a* is supported by the brackets 13*a* of the frame means 3 and the paper or other sheet material issues therefrom through the slot or gap 12 as described above and as is shown in FIG. 4A. While the roll P*a* becomes exhausted to an extent such as that illustrated in FIG. 4A, the second roll P*b* is mounted on the frame means 3, and more particularly on the brackets 13*b* thereof with the parts having the position illustrated in FIG. 4A. When the diameter of the roll P*a* has been reduced at least approximately to a given extent, the frame means 3 is swung either in a clockwise direction B or the counterclockwise direction C, as illustrated in FIG. 4A. In this way the first roll P*a* will be displaced away from the feed position while the second roll P*b* is moved into the feed position in the manner described above.

The direction of rotation of the frame means 3 is selected in accordance with the manner in which the paper is fed from the first roll P*a* and is wound on the second roll P*b*.

Figure 4B:
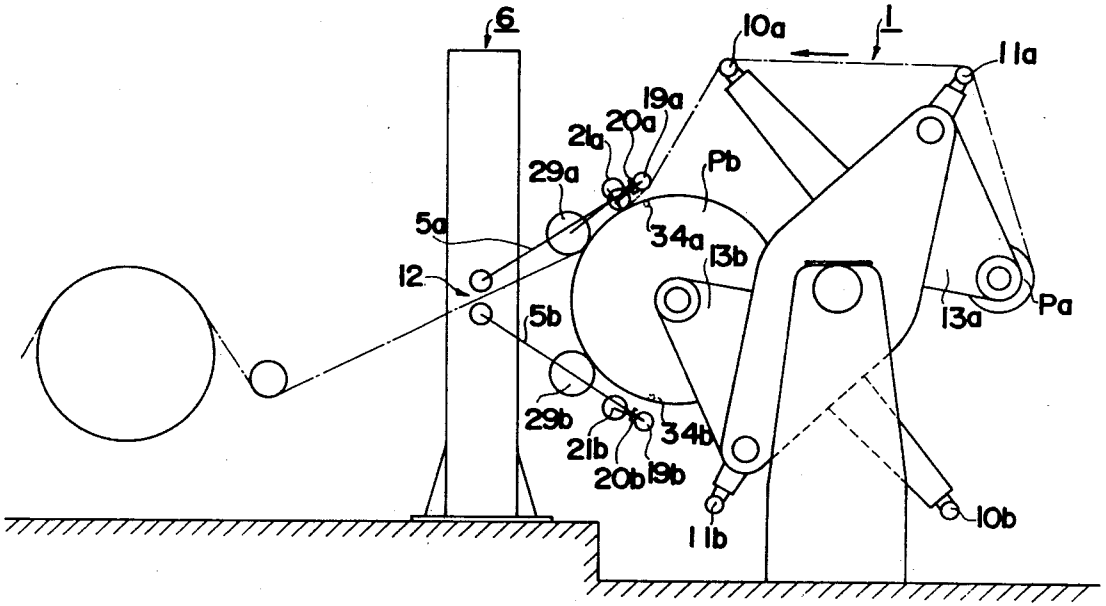
FIG. 4B shows the position which the parts of FIG. 4A taken when a roll-carrying frame is swung in a clockwise direction.
Figure 5A:
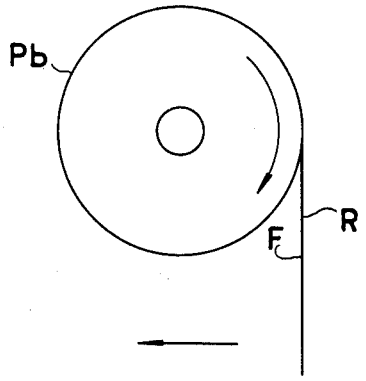
FIGS. 5A–5D respectively illustrate the different possible positions of rolls with differently situated front and rear surfaces on the sheet material.
Figure 5B:
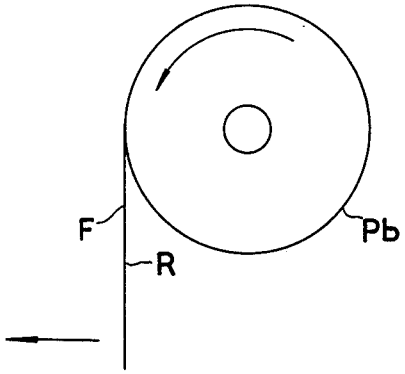

Assuming that the sheet material has front and rear surfaces or different appearances, respectively, and that the sheet material is fed from the roll P*a* in FIG. 4A with the front surface directed upwardly, then there are two possibilities as shown in FIG. 5A and 5B. Thus, some manufacturers will wind the sheet material so that the front surface F thereof is directed inwardly toward the axis of the roll P*b*, as shown in FIG. 5A, while other manufacturers will wind the sheet material so that the front surface F thereof is directed outwardly away from the axis of the roll P*b*, as shown in FIG. 5B, where the front surface F is indicated as opposed to the rear surface R. If the roll P*b* is wound with the front surface F of the sheet material directed inwardly toward the axis of the roll, as shown in FIG. 5A, then for the case where the sheet material issues from the roll P*a* with the front surface directed upwardly, the operator will mount the roll P*b* on the brackets 13*b* so that the sheet material will be unwound from the roll P*b* with the latter turning in a clockwise direction and with the web issuing from the bottom of the roll, as indicated in FIG. 5A by the arrows. On the other hand, if the sheet material is wound as shown in FIG. 5B, then the roll P*b* will be mounted as shown in FIG. 5B and the web of sheet material will be unwound from the top of the roll with the latter turning in a counterclockwise direction, as also indicated by the arrows in FIG. 5B. In this way it will be possible to have the sheet material issuing from the roll P*b* with the front surface thereof directly upwardly so as to move the same orientation as the sheet material issuing from the roll P*a*. Assuming that the front surface of the sheet material is directed outwardly as shown in FIG. 5B, then the frame means 3 will be rotated in a clockwise direction, as indicated by the arrow B in FIG. 4A, and the parts will then assume the position shown in FIG. 4B where the web issuing from the almost exhausted roll P*a* is located over the second roll P*b*. Thus when the feed continues from the new roll P*b* the web will issue therefrom with the same orientation as the web from the previous roll P*a*. It will be noted that at this time during the swinging of the frame means 3 from the position of FIG. 4A into the position of FIG. 4B, the rollers 11*a* and 10*a* prevent the web issuing from the almost exhausted roll P*a* from engaging the new roll P*b*, so that the feed continues without any interference from the new roll during the replacement operations.

Figure 4C:
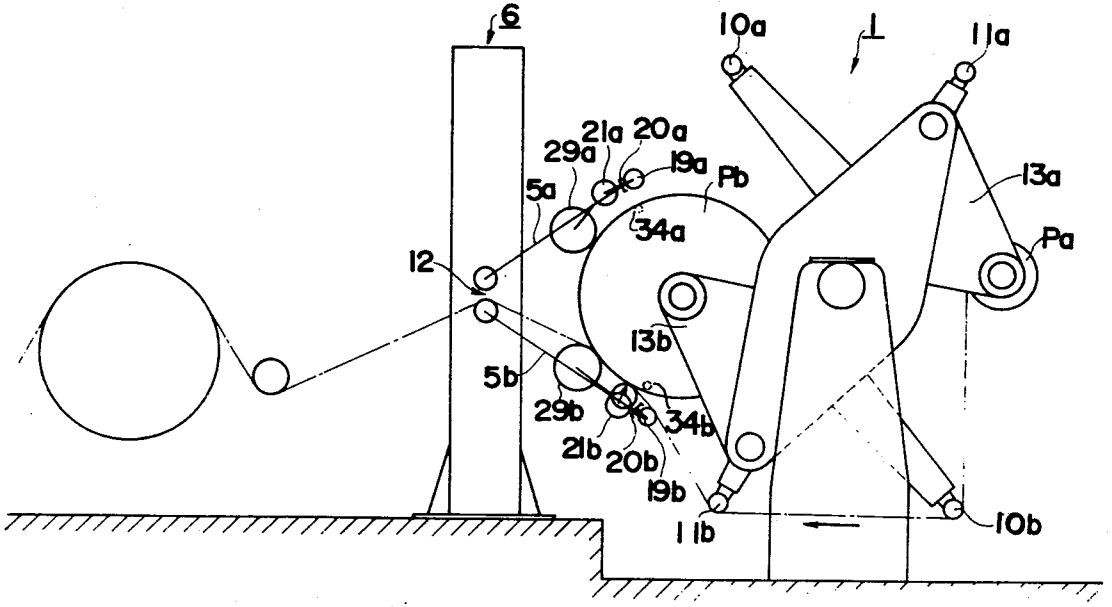
FIG. 4C shows the position which the parts of FIG. 4A take when the roll-carrying frame is swung in a counterclockwise direction.

On the other hand, if the roll is wound by the manufacturer so that the front surface of the sheet material is directed inwardly as shown in FIG. 5A, then the frame means 3 is swung in the direction of the arrow C of FIG. 4A, so that the parts will assume the position shown in FIG. 4C with the web which continues to issue from the roll P*a* extending beneath the new roll P*b*, and at this time it is the rollers 10*b* and 11*b* which maintain the web which continues to issue from the roll P*a* out of engagement with the new roll P*b* during the replacement operations.

Figure 5C:
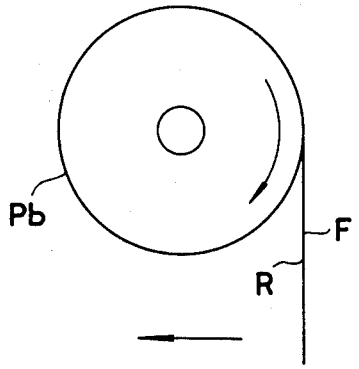
Figure 5D:
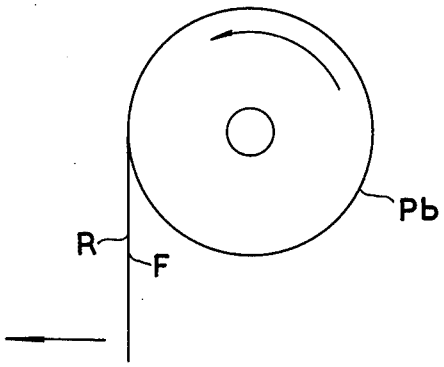

If the web of sheet material issues from the roll P*a*, as shown in FIG. 4A, with the front surface of the sheet material directed downwardly, then the roll P*b* which is shown in FIG. 5B will be mounted on the frame means 3 in the position shown in FIG. 5C, and the frame means 3 will be swung in the direction of the arrow C so that it becomes possible to continue the feed from the bottom of the new roll with the front surface of the sheet material directed downwardly. If in the same situation where the sheet material from the roll P*a* has its front surface directed downwardly, with sheet material of the new roll P*b* wound as shown in FIG. 5A, then in this case the roll is mounted on the frame means 3 in the manner shown in FIG. 5D, so that upon swinging of the frame means 3 in the clockwise direction B it will be possible for the feed to continue from the new roll with the front surface of the sheet material still directed downwardly.

Since the rollers 10*a*, 10*b*, 11*a*, 11*b* always maintain the sheet material issuing from the first roll out of engagement with the second roll during the replacement operations it is possible for the feed to go forward continuously in a smooth manner without any interruption during the replacement operations.

When the second roll P*b* has reached the feed position, as indicated either in FIG. 4B or in FIG. 4C, the motors 15*a* and 15*b* are energized to swing the upper and lower combined pressing and rotating means from their rest positions to the operating positions, and this swinging is terminated by the sensors 34*a* and 34*b*, as described above. In this way the pair of combined pressing and rotating means will be accurately positioned with respect to the new roll. In the case of FIG. 4B, it is the upper driving rolls 29*a* which engage the web issuing from the almost exhausted roll P*a*, while in the case of FIG. 4C, it is the lower rolls 29*b* which engage the web which continues to issue from the almost exhausted roll P*a*. With the arms 5*a* and 5*b* thus located at their operating positions, the motor 33 is energized to rotate in one direction or the other, so as to transmit a drive to the driving rolls 29*a* and 29*b* in order to rotate the latter. In the case of FIG. 4B, the rolls 29*a* and 29*b* will be driven in a clockwise direction while in the case of FIG. 4C, the rolls 29*a* and 29*b* will be driven in a counterclockwise direction. Thus, the rolls 29*a* or 29*b* which engage the web which continues to issue from the first roll P*a* will be driven from the motor 33 and the sensors referred to above will sense the speed at which it is required to rotate the driving rolls 29*a* or 29*b* so that they will be driven without any slip between the rolls 29*a* or 29*b* and the web engaging one or the other of these pairs of driving rolls. With the rolls 29*a* and 29*b* thus rotating at a peripheral speed equal to the speed of travel of the web issuing from the almost exhausted roll P*a*, the motors 27*a* and 27*b* are energized to swing the arm assemblies 23*a* and 23*b*, thus bringing the driving rolls 29*a* and 29*b* inwardly toward the axis of the new sheet material roll P*b*. In the case of FIG. 4B this operation will cause the rolls 29*a* to press the web issuing from the roll P*a* against the roll P*b* so as to rotate together with the web and at the same time drive the roll P*b* in a counterclockwise direction, as viewed in FIG. 4B, at the same peripheral speed as the linear speed of the web issuing from the roll P*a*. In a similar manner with the arrangement shown in FIG. 4C, it is the lower driving rolls 29*b* which on the one hand press the web still issuing from the almost exhausted roll against the new roll while rotating the latter by the pressure applied through the web.

With the description as set forth above, both of the upper and the lower combined pressing and rotating means are simultaneously swung from their rest to their operating positions. In this way when the parts have the positions shown in FIG. 4B, it is possible for the lower rolls 29*b* to engage directly the new roll P*b* so as to participate in the rotation thereof, thus aiding the rolls 29*a* which act through the web which still issues from the roll P*a*. In the case of FIG. 4C, where the driving rolls 29*a* and 29*b* rotate in a counterclockwise direction, it is the roll 29*a* which directly engages the new supply roll P*b* so as to participate in the rotation thereof while the drive rolls 29*b* act through the web which still issues from the almost exhausted roll P*a*. However it is equally possible to provide an arrangement where only the upper combined pressing and rotating means in the case of FIG. 4B and lower combined pressing and rotating means in the case of FIG. 4C are swung to their operating positions so that the second roll P*b* is driven only by way of the drive from the drive rolls as applied through the web which still issues from the almost exhausted roll.

Figure 6:
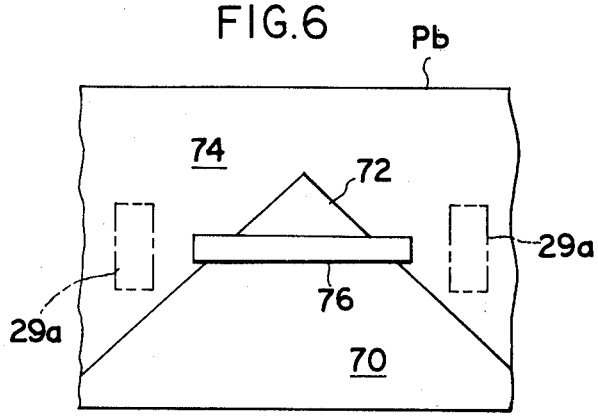
FIG. 6 is a schematic representation of the cooperation between a new roll and a pair of driving rolls.

As is shown schematically in FIG. 6, it is customary for manufacturers of the rolls P*b* to provide at the outermost layer 70 thereof a free end portion 72 of reduced width situated centrally between the ends of the roll and having, for example, the triangular configuration illustrated in FIG. 6. In this way each roll is provided with a triangularly shaped leader. In order to fix the outermost layer 70 to the next inner layer 74 of the roll P*b*, an elongated adhesive strip 76 is applied across the free end portion 72 extending beyond the latter on to part of the next inner layer 74, so that such an adhesive strip 76 will fix the outermost layer to the next inner layer and thus hole the sheet material in its wound condition on the roll. In this way unwinding is prevented during transportation of the roll. The strip 76 is adhesive on both of its surfaces, so that the exposed surface of the strip 76 which is visible in FIG. 6 is composed of a pressure-sensitive adhesive material. If a sheet material is placed in engagement with this exposed surface of the adhesive strip 76 and pulled away from the layer 74, then the layer 70 will become detached from the layer 74. The reason for this is that the sheet applied to the exterior pressure-sensitive adhesive surface of the strip 76 engages the latter over a much larger area than the area of engagement between the strip 76 and the inner layer 74, and this operation is further enhanced by the fact that generally the area of contact between the strip 76 and the outermost layer 70 is also greater than the area of contact with the next layer 74, as illustrated as diagrammatically in FIG. 6.

The position of the driving rolls 29*a* with respect to the roll P*b* is schematically illustrated in FIG. 6 for the case of FIG. 4B. Thus it will be seen that these driving rolls 29*a* are situated outwardly beyond the strip 76. As a result the web issuing from the almost exhausted roll P*a* will not adhere to the strip 76 and instead the web will continue to travel from the almost exhausted roll P*a* while the new roll P*b* is rotated at a speed corresponding to the speed of travel of the web from the almost exhausted roll P*a*. Of course the rolls 29*b* will have the same relationship with respect to the strip 76 in the case of FIG. 4C. Thus the distances between the rolls 29*a* or between the rolls 29*b* are such that these rolls will be located outwardly beyond the adhesive strip which customarily is used to connect the outermost layer to the next layer of a new roll. As a result the new roll rotates without any unwinding of the sheet material therefrom while the web from the old roll is pressed against the new roll.

When the sheet material from the first roll P*a* has almost completely run out, the motors 28*a* in the case of FIG. 4B or 28*b* in the case of FIG. 4C are energized to swing the pressure roller 21*a* into engagement with the web issuing from the roll P*a*, in the case of FIG. 4B, or the pressure roller 21*b* in engagement with the web issuing from the almost exhausted roll in the case of FIG. 4C. In either case this will result in pressing the web from the old roll firmly against the strip 76 so as to detach the outer layer 70 from the next inner layer 74 of the new roll, and in this way the webs from the old and new rolls are attached to each other and the unwinding from the new roll starts. Thus, it will be seen that the pressure rollers 21*a* and 21*b* form together with the structure associated therewith an attachment-effecting means for effecting attachment of the sheet material from the second roll to the sheet material of the first roll by pressing a portion of the sheet material of the first roll against a portion of the second roll which is not engaged by the combined pressing and rotating means, the latter serving to set the second roll into rotation prior to actual effecting of the attachment of the sheet material of the second roll to that of the first roll. Immediately after the unwinding from the new roll starts the cutting means 20*a* in the case of FIG. 4B or the cutting means 20*b* in the case of FIG. 4C cuts across the sheet material from the old roll at a location between the latter and the connection between the webs of the old and new rolls, so taht now the feeding from the roll P*a* terminates and continues without interruption from the roll P*b*. The motors 15*a* and 15*b* as well as the motors 27*a*, 28*a*, 27*b*, 28*b*, are all then driven in the reverse direction so as to return the parts to their rest positions, and of course the motor 33 is also stopped so that the drive to the rollers 29*a* and 29*b* is also terminated.

Although in the apparatus described above the cutting means is situated upstream of the attaching roller 21*a* or 21*b*, it is also possible to provide an apparatus where the cutter is actuated after a predetermined time has elapsed from the instant when a change in the thickness of the paper fed through the slot 12 is first detected, indicating that the webs from the two rolls have become attached to each other. Such a detecting means which detects the increase in the thickness resulting from the combination of the two webs can be used to actuate a cutter which can be situated downstream of the pressure roller 21*a* or 21*b* at a location suitable for cutting across the web which issues from the remnant of the almost exhausted roll P*a*. In any event the timing of the operation of the components is such that the cutting means cannot operate to cut the web issuing from the old roll until this web has become attached to the web from the new roll with the latter web unwinding from the new roll.

It will be noted that with the apparatus of the invention it is possible to carry out a highly accurate sheet-material connecting operation with the desired surface of the sheet material oriented in a desired direction irrespective of whether the sheet material is initially wound with this desired surface thereof directed inwardly or outwardly. In addition, the method and apparatus can be used with supply rolls of different diameters. Furthermore, the operations can go forward automatically as well as accurately to carry out the transition of the supply from one roll to the next in a rapid manner while maintaining the continuous supply of sheet material without requiring the services of highly skilled operators and without in any way interrupting the supply of sheet material.

What is claimed is:

1. In an apparatus for connecting sheet material from a first roll to the sheet material from a second roll without interrupting the feeding of the sheet material when changing from the first to the second roll, the sheet material of the second roll having the capability of becoming attached to the sheet material of the first roll in conjunctin with pressing of the sheet material of the first roll against an attaching portion at the outermost layer of the sheet material of the second roll, said attaching portion being axially shorter than the width of the sheet material of the second roll, frame means for supporting the first and second rolls with the first roll located in a feed position while sheet material is unwound therefrom, supporting means supporting the frame means for movement along a path displacing the first roll away from said feed position while the sheet material continues to be unwound therefrom and while simultaneously displacing the second roll into the feed position, combined pressing and rotating means having an operating position pressing the web of sheet material issuing from the first roll against the second roll at a location of the latter spaced axially beyond said attaching portion thereof while rotating the second roll, said support means supporting said combined pressing and rotating means for movement between a rest position and said operating position, attachment-effecting means connected for movement with said combined pressing and rotating means but spaced along the axis of said second roll at a location different from the location along said axis of said combined pressing and rotating means and in axial alignment with said attaching portion at said outermost layer of said second roll for pressing the sheet material of said first roll against said outermost layer of said second roll after rotation of the second roll by said combined pressing and rotating means has started, for effecting attachment of the sheet material of said second roll to the sheet material of said first roll, so that the sheet material starts to unwind from the second roll simultaneously with the travel of the sheet material from the first roll, and cutting means connected for movement with said attachment-effecting means for responding to operation of the latter effecting attachment of the sheet material of the second roll to the sheet material of the first roll for cutting across the web of sheet material issuing from the first roll at a location between the first roll and the connection of the outermost layer of the second roll to the web from the first roll, for terminating the feed from the first roll and continuing the feed with the sheet material from the second roll, said frame meanas supporting said first and second rolls for rotary movement about a pair of parallel horizontal axes, and said support means supporting said frame means for swinging movement around an intermediate axis situated between the axes of rotation of the first and second rolls during movement of the frame means along the path which displaces the first roll away from the feed position and the second roll into the feed position, said support means including a stand and a pair of idler rolls carried by said stand at the elevation of the feed position and defining between themselves a slot through which a web of sheet material moves when issuing from a roll at said feed position, and said stand carrying a pair of said combined pressing and rotating means respectively extending above and below said idler rolls for swinging movement from said rest positions respectively in opposite directions to said operating positions so that a web of sheet material on a roll at said feed position can issue either from the top or from the bottom thereof, each said combined pressing and rotating means having a said attachment-effecting means and a said cutting means connected for movement therewith.

2. The combination of claim 1, an adhesive element at the attaching portion of the second roll, and wherein each of said combined pressing and rotating means includes a pair of lever arms swingably connected to said stand for swinging movement about a common axis to displace the combined pressing and rotating means between the rest and operating positions thereof, each of said combined pressing and rotating means including a pair of drive rolls for pressing against a web issuing from the first roll of sheet material and holding the latter web in engagement with the second roll while the latter is at the feed position and for rotating the second roll, said lever arms having means carrying said attachment-effecting means for swinging movement with respect to said lever arms into a position pressing the web issuing from the first roll into engagement with said adhesive element carried by the outermost layer of the second roll to attach the sheet material from the second roll to the web issuing from the first roll, and said cutting means also being carried by said levers for swinging movement through a cutting stroke subsequent to attaching of the web issuing from the first roll to the sheet material of the second roll.

3. The combination of claim 2 and wherein the pair of drive rolls of each combined pressing and rotating means are spaced along an axis parallel to the axis of a roll at the feed position to be located beyond said adhesive element carried by the second roll while the attachment-effecting means includes a pressure roll aligned with the space between the drive rolls to be swung for pressing the web from the first roll into engagement with the adhesive element attached to the outermost layer of the second roll.

4. The combination of claim 1 and wherein a sensing means is carried by each of said combined pressing and rotating means for sensing when the latter has reached said operating position and for terminating the movement of each combined pressing and rotating means from said rest position to said operating position, so that by way of said sensing means each combined pressing and rotating means can operate on rolls of varying diameters.

* * * * *